United States Patent [19]

Ostrander et al.

[11] 4,042,068

[45] Aug. 16, 1977

[54] ELEVATOR SYSTEM

[75] Inventors: William M. Ostrander, Hackensack; William J. Casper, Mountainside, both of N.J.

[73] Assignee: Westinghouse Electric Corporation, Pittsburgh, Pa.

[21] Appl. No.: 590,164

[22] Filed: June 25, 1975

[51] Int. Cl.[2] ..... B66B 1/28

[52] U.S. Cl. ..... 187/29 R

[58] Field of Search ..... 187/29

[56] References Cited

U.S. PATENT DOCUMENTS

| | | | |
|---|---|---|---|
| 1,944,471 | 1/1934 | Seeger | 187/29 |
| 3,207,265 | 9/1965 | Lund et al. | 187/29 |
| 3,486,101 | 12/1969 | Rufli | 187/29 |
| 3,507,360 | 4/1970 | Ostrander et al. | 187/29 |
| 3,614,996 | 10/1971 | Saito et al. | 187/29 |
| 3,902,572 | 9/1975 | Ostrander | 187/29 |

*Primary Examiner*—Robert K. Schaffer
*Assistant Examiner*—W. E. Duncanson, Jr.
*Attorney, Agent, or Firm*—D. R. Lackey

[57] ABSTRACT

A traction elevator system in which the floor leveling device is active when the elevator door is open, and it is maintained active while the door is closing. The brake is partially released and the drive motor is activated when the elevator car receives a signal to start, and full release of the brake is initiated before the door, when closing, reaches the closed position, preparatory to a run. The leveling device, partial brake release and armature current buildup in the drive motor cooperate to provide a motor torque which exactly balances the unbalanced load, to hold the elevator car at floor level as the brake is fully released. When the door reaches the closed position, the car may be smoothly started without delay or "bump", as the brake is fully released and the unbalanced load is already compensated for.

8 Claims, 7 Drawing Figures

ELEVATOR SYSTEM

BACKGROUND OF THE INVENTION

1. Field of the Invention

The invention relates in general to elevator systems, and more specifically to elevator systems of the traction type.

2. Description of the Prior Art

It is common in traction elevator systems to set the brake to restrain rotation of the traction or drive sheave when the elevator car is stopped at floor level with its door open to permit passenger transfers. The floor leveling device may be maintained active during passenger transfer to permit stretch of cable leveling during which the brake is partially released to allow the elevator drive motor to overcome the partial restraint of the brake to maintain the elevator car at floor level as the load in the elevator increases or decreases. When a run is to be made the leveling device is deactivated, door closure is initiated, and the elevator car is held stationary with the brake until its door reaches the closed position. The brake is then released and the acceleration pattern applied to the drive motor to move the car away from the floor. With a geared traction elevator, the gear aids the brake in restraining sheave movement when the car is stopped and the brake may be relatively small, compared with the brake required in a gearless elevator system where the brake is "right on the cables". The inductive lag in a small brake is relatively short and thus the car may be started without appreciable delay after the door reaches the closed position. The large brake on a gearless elevator has a substantial time constant, which may be in the range of ½ to 2 seconds, and thus the car is delayed in leaving the floor level, waiting for full brake release. Also, depending upon car direction and unbalanced load, a rough start or bump may be experienced as the drive motor builds up armature current to compensate for the unbalanced load, and considerable effort has been expended to improve the starts for all load conditions.

SUMMARY OF THE INVENTION

Briefly, the present invention is a new and improved traction elevator system, which shortens the time between the initiation of door closure and the starting of the elevator car away from a floor, and which provides smooth starts for all load conditions while maintaining the elevator car at floor level until the door reaches the closed position. Thus, the new and improved traction elevator system is especially suitable for traction elevators with a gearless drive, which have large brakes with appreciable inductive time lags.

More specifically, the new and improved elevator system maintains the floor leveling device active when the door is open, and also while it is closing. The elevator drive motor is active during door closure, as it is responsive to the leveling device. When the car receives a signal to start and to initiate the closing of its door, the brake is partially released to permit the leveling device to maintain the car precisely at floor level. At a predetermined point during closure of the door, full release of the brake is initiated. The early partial release of the brake allows armature current to build up in the drive motor responsive to the leveling device, to provide the torque necessary to offset the unbalanced load and to maintain the car at floor level. The predetermined door position at which full brake release is initiated is selected such that it is closed to the point where passenger transfer is no longer possible, yet sufficient time remains between this partially closed position and full door closure to allow the brake to be substantially fully released when the door reaches the closed position. Thus, the elevator car may be started away from the floor after door closure without waiting for the full inductive time lag of the brake, and in most cases it may be started at once following the issuance of the signal which signifies that the car and hatch doors are closed and locked. Since the unbalanced load is already compensated for, the car starts smoothly in its travel direction without hesitation or bump. The motor also provides a backup for the mechanical brake during door closure.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENTS

The present invention may be employed in various types of traction elevator control systems, and is especially suitable for gearless traction elevator systems in which a variable direct current voltage is applied to a direct current motor which drives the traction sheave. The variable direct current voltage may be provided by a solid-state bridge rectifier arrangement, or by a motor generator set as in the conventional Ward Leonard arrangement. For purposes of example, it will be assumed that the variable direct voltage is provided by a motor generator set, and in order to simplify the description of the invention the control arrangement of the traction elevator system disclosed in U.S. Pat. No. 3,207,265, which is assigned to the same assignee as the present application, will be modified to illustrate the teachings of the invention. Only that part of U.S. Pat. No. 3,207,265 which is necessary to understand the present invention will be repeated herein, as this patent may be referred to if additional information is desired. Accordingly, U.S. Pat. No. 3,207,265 is hereby incorporated into the present application by reference.

Figure 1:
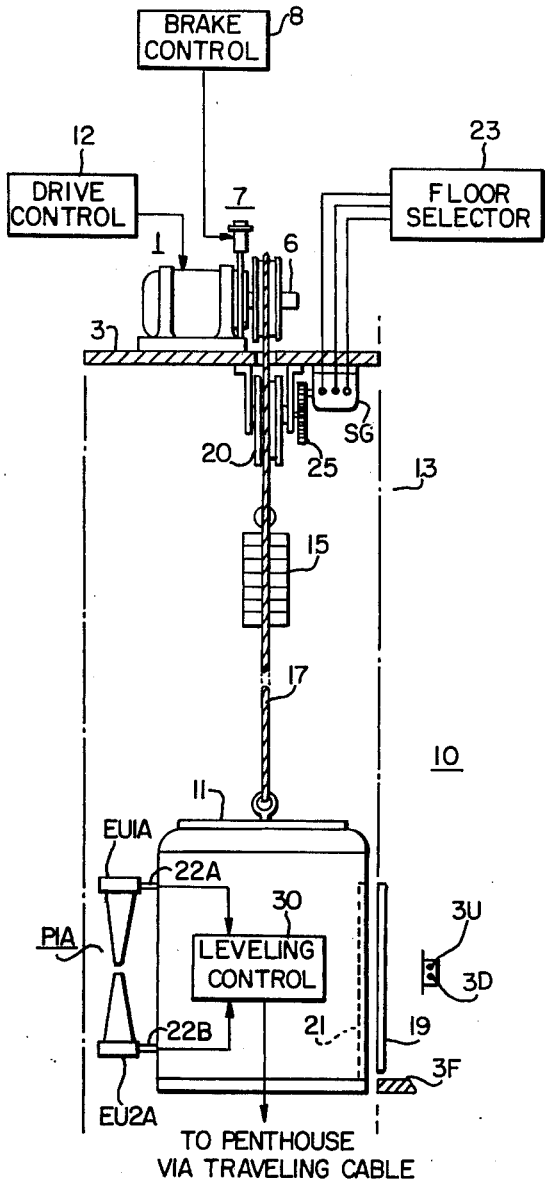
FIG. 1 is a diagrammatic view of a traction elevator system which may utilize the teachings of the invention.
Figure 2:
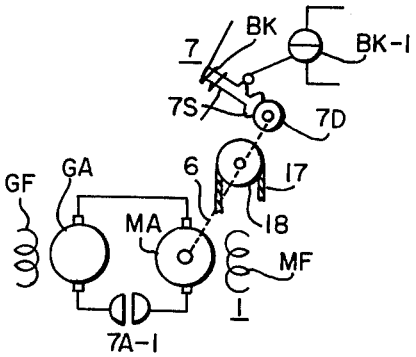
FIG. 2 is a schematic diagram which illustrates a traction drive arrangement which may be used for the elevator system shown in FIG. 1.

Referring now to the drawings, and FIG. 1 in particular, there is shown an elevator system 10 which includes an elevator drive motor 1 secured to the upper surface of a floor 3, which may be located in the penthouse of a building being served by the elevator system 10. As illustrated in FIG. 2, the elevator drive motor 1 includes an armature MA connected to a generator armature GA in a loop circuit via a make contact 7A-1 of the loop circuit contactor 7A. The motor and generator field windings are shown generally at MF and GF, respectively. The elevator drive motor 1 has a traction sheave 18 secured to its shaft 6, and an elevator brake 7 is associated with the elevator motor and the traction sheave in a conventional arrangement. For example, as illustrated in FIG. 2, the elevator brake 7 has a brake shoe 7S which is spring applied to a brake drum 7D secured to the shaft 6 to hold the traction sheave 18 stationary, and is released in response to the energization of a brake coil BK. A secondary or idler sheave 20, if used, is normally secured to the lower surface of the penthouse floor 3.

An elevator car 11 is mounted for movement in a hoistway 13 to serve the various floors or landings of the building associated therewith. The elevator car 11 is connected to a counterweight 15 by means of one or more ropes or cables 17 which pass around the traction sheave 18 and the secondary sheave 20 in a conventional manner.

Figure 5:
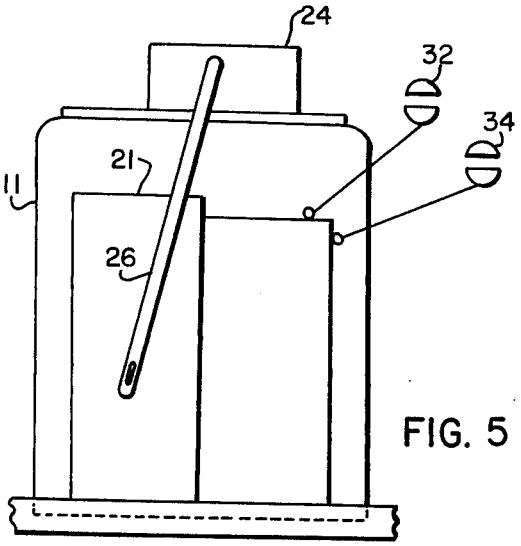
FIG. 5 is an elevational view which illustrates the development of certain door position signals used in the invention.

At each floor served by the elevator car, a hoistway, hatch, or floor door 19 is provided. In addition, the elevator car has a door or gate 21 which registers with the hoistway door at any floor at which the elevator car is stopped. The door and the gate may be of conventional construction and may be operated automatically in any conventional way. For example, as illustrated in FIG. 5, a door operator 24 mounted on the car 11 may be linked to the door 21 via linkage 26.

The elevator car 11 includes the usual car call pushbuttons (not shown) for passengers to register calls for their destination floors, and up and down pushbuttons may also be provided in the elevator car for operation by a car attendant in order to condition the elevator car for up or down travel. Travel direction may automatically be selected by directional circuits when the elevator car is on automatic operation.

As illustrated in FIG. 1, an up pushbutton 3U is provided at the third floor 3F for operation by a person desiring transportation from this floor in the up direction. A similar pushbutton would be provided at each of the floors from which a person may desire to travel in the up direction. In a similar manner, FIG. 1 shows a down pushbutton 3D at the third floor which may be operated by a person desiring to travel in the down direction. A similar pushbutton would be located at each floor from which a person may desire transportation in the down direction.

Control of the operation of the elevator car is provided by a floor selector 23. The floor selector 23, for example, may be the one illustrated in U.S. Pat. No. 2,874,806, and it will not be described in detail. The floor selector 23 may be driven in synchronism with movement of the elevator car 11 from a signal generator SG coupled to the secondary sheave 20 through gearing 25, or it may use a drive tape which is driven by movement of the elevator car, or any other suitable means may be used.

As the elevator car approaches a floor at which it is to stop, it is desired that it stop automatically and accurately in registration with such floor. To this end, position responsive mechanism is provided in the hoistway and on the elevator car. Thus, FIG. 1 shows a hoistway transducer comprising a pair of electromagnetic units EU1 and EU2 respectively mounted on brackets 22A and 22B which are secured to the elevator car. Separate inductor plates or vanes constructed of magnetic material such as steel are located in the hoistway adjacent each of the floors served by the elevator car. When the car is stopped accurately at a floor, the units EU1 and EU2 are associated with the plate PlA for such floor in the manner illustrated in FIGS. 1, 3 and 4. The plate PlA conveniently may be fabricated of two closely spaced separate and similar sections, an upper section PlA1 and a lower section PlA2.

Figure 3:
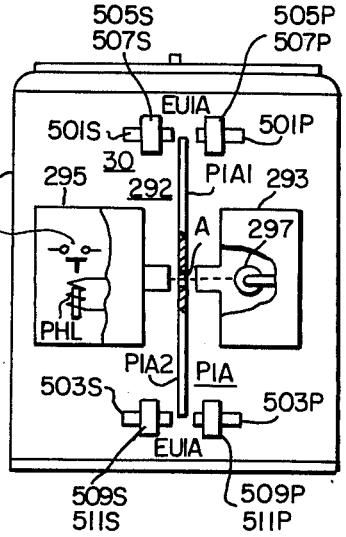
FIG. 3 is an elevational view of leveling apparatus which may be used with the elevator system shown in FIG. 1.
Figure 4:
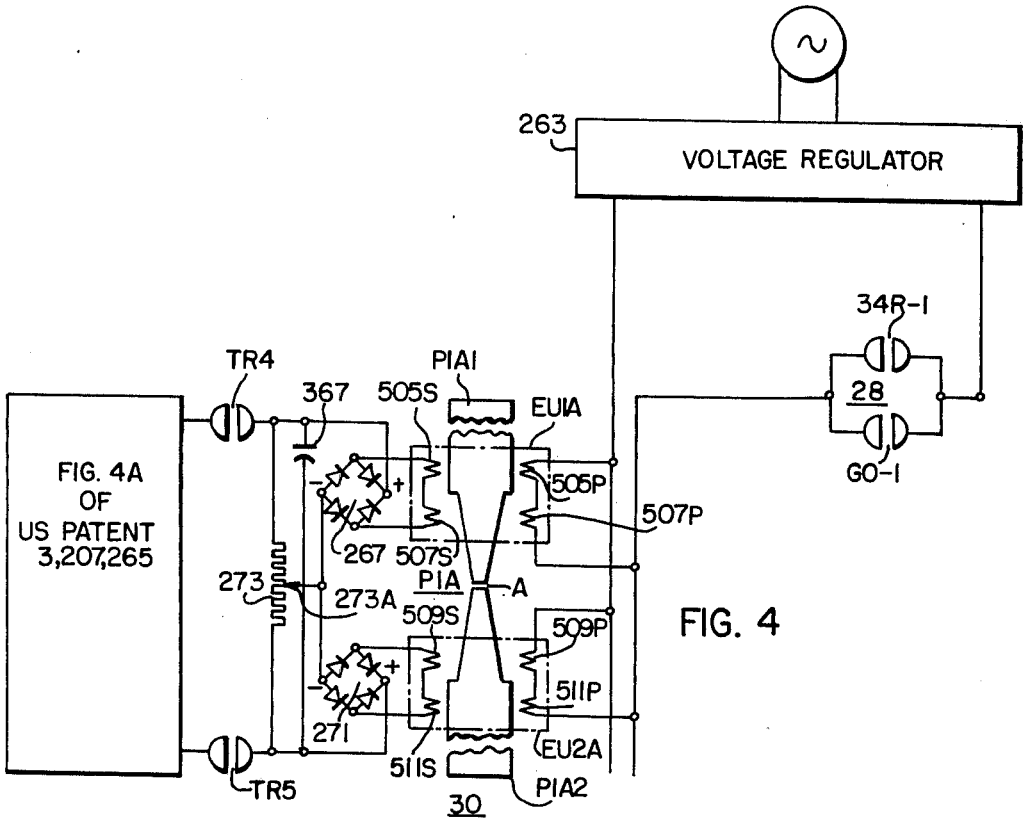
FIG. 4 is a schematic diagram of the leveling device or apparatus shown in FIG. 3.

Referring to FIGS. 3 and 4, unit EU1A includes a pair of soft magnetic cores 501P and 501S, which are C-shaped and which have pole faces adjacent each other to define a rectangular magnetic path. Unit EU2A includes a pair of soft magnetic cores 503P and 503S, which are also C-shaped and which have pole faces adjacent each other to define a rectangular magnetic path. Magnetic core 501P is provided with primary windings 505P and 507P which are connected to direct magnetic flux in the same direction around the associated magnetic path. Magnetic core 501S has secondary windings 505S and 507S, which have voltages induced therein by magnetic fluxes passing through the associated magnetic path. Magnetic core 503P is provided with primary windings 509P and 511P, which are connected to direct magnetic flux in the same direction around the associated magnetic path, while the magnetic core 503S has secondary windings 509S and 511S, which have voltages induced therein by magnetic fluxes passing through the associated magnetic path.

The magnitude of the voltages induced in each of the secondary windings 505S, 507S, 509S and 511S depends upon the position of the plate PlA with respect to the associated magnetic cores. When the plate PlA is located between the magnetic cores it shields the secondary windings from the magnetic flux produced by the primary windings. The extent of such shielding depends upon the position of the plate with respect to the magnetic cores.

The electromagnetic units EU1A and EU2A are brought into operation during the last stage of the approach of the elevator car to a floor at which it is to stop, in order to terminate movement of the elevator car accurately at the floor and to maintain it level with the desired floor. As the elevator car reaches the desired zone, a transfer relay TR (not shown) closes its make contacts TR4 and TR5 shown in FIG. 4, to render the electromagnetic units EU1A and EU2A effective for controlling the elevator car. When the elevator car reaches the position illustrated in FIG. 3, adjacent the floor, substantially minimum voltage is induced in each of the secondary windings 505S, 507S, 509S and 511S, since the units EU1A and EU2A are adjacent portions of the plate PlA which provide maximum shielding.

The primary windings 505P and 507P of the electromagnetic unit EU1A are connected in series aiding across the output terminals of a voltage regulator 263 via a parallel circuit 28 which includes make contacts 34R-1 in one branch and make contacts GO-1 in another branch. Relay 34R is the master slow-down relay which is energized when the elevator car initiates slow-down, and remains energized while the elevator car is stopped at the floor with its door open, dropping out when door closure is initiated preparatory to making the next run. The relay GO will be hereinafter described.

The primary windings 509P and 511P of the electromagnetic unit EU2 are connected in series aiding across the output terminals of the voltage regulator via the parallel circuit 28.

The secondary windings 505S and 507S of unit EU1A are connected in series aiding across the input terminals of a full-wave rectifier 267. In like manner, the secondary windings 509S and 511S of unit EU2A are connected in series aiding across the input terminals of a full-wave rectifier 271. The output of rectifier 267 is applied across the upper half of a resistor 273, while the output of rectifier 271 is applied across the lower half of resistor 273. The specific portion of the resistor 273 utilized as a load for the rectifiers may be adjusted by tap 273A on the resistor, and, if desired, a filter capacitor 367 may be connected across resistor 273.

As the elevator car reaches a position of registry with the floor, the units EU1A and EU2A will have practically zero output, and the voltage applied to the pattern motor winding of the associated speed pattern generator is reduced to zero, to reduce the elevator car speed to zero. Thus, the elevator car should come to rest accurately at the floor level. Should the elevator car, when its gate and the hoistway door for the particular floor are open, be displaced by more than ¼ inch from a position of registry with the floor for any reason, such as cable contraction or stretch, the outputs of the units EU1A and EU2A will be unbalanced, and the pattern motor winding will be energized with the proper polarity to return the car slowly into accurate registration with the floor.

FIG. 3 illustrates that the electromagnetic leveling control of FIGS. 1, 3 and 4 may also include photoelectric control apparatus 292. The photoelectric control apparatus 292 is described in detail in U.S. Pat. No. 3,138,223, which is assigned to the same assignee as the present application, and this patent is also incorporated into the present application by reference.

Specifically, photoelectric control apparatus 292 includes a transmitting device 293 and a detecting device 295 which is spaced from the transmitting device. The transmitting device projects a beam of radiant energy to the detecting device across the space therebetween. The radiant energy projected by the transmitting device 293 may have a frequency selected from a wide range. For example, the transmitting device may be designed to project visible light, or to project infrared radiant energy. For example, the transmitting device may include a lamp 297 which is effective when energized to emit visible light.

The detecting device 295 may be of any type responsive to the radiant energy received from the transmitting device 293. Thus, the detecting device may be of the photoemissive type, the photoconductive type, or the photovoltaic type, as desired. The detecting device 295 also includes a photocell relay PHL. When radiant energy is not being received by the detecting device 295, relay PHL is de-energized and dropped out to open its make contacts PHL-1. When radiant energy is received and detected by the detecting device 295, relay PHL is energized to close its contacts PHL1.

Plate PlA has a relatively small aperture or spacing between its plates PlA1 and PlA2. Thus, when the elevator car is in a position of registry with the floor, the detecting device 295 receives radiant energy transmitted by the transmitting device 293 to energize and pick up the relay PHL. As the car moves away from the floor such as 0.25 inch in either direction, the plate PlA interrupts the reception of radiant energy to drop out the relay PHL. The dropout of relay PHL initiates releveling, controlling the leveling relay L, as will be hereinafter explained.

FIG. 5A illustrates door position related contacts 32 and 34 which close when the elevator door reaches a predetermined position when the door is closing, and when it is closed. The predetermined door position where contact 32 closes will be hereinafter described. Contact 34 is connected in the circuit which includes the car door relay 40R. Relay 40R is energized when the car door is closed.

Figure 6:
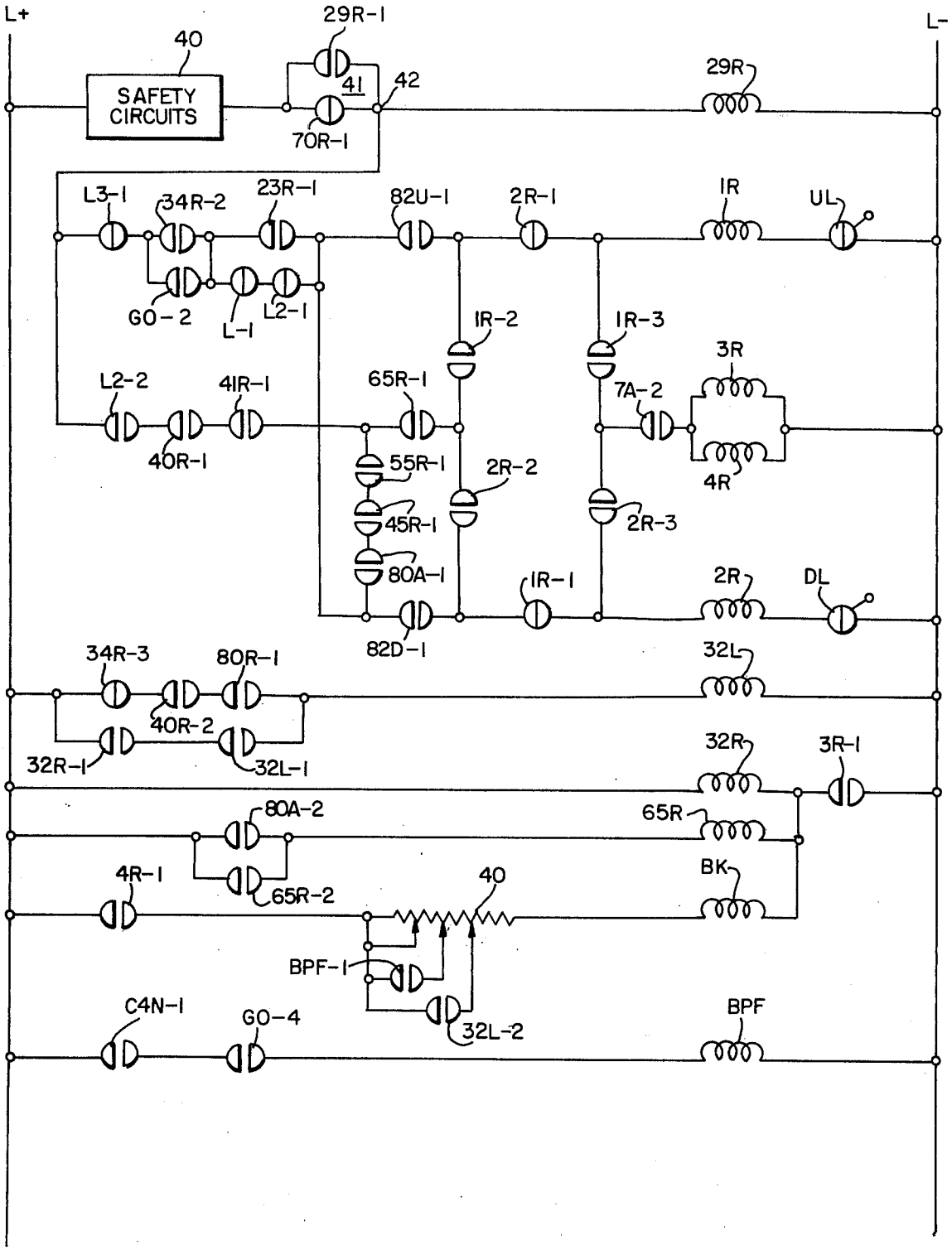
FIGS. 6 and 7 are schematic diagrams of control circuits which embody the teachings of the invention, which control circuits are suitable for use with the elevator system shown in FIG. 1.
Figure 7:
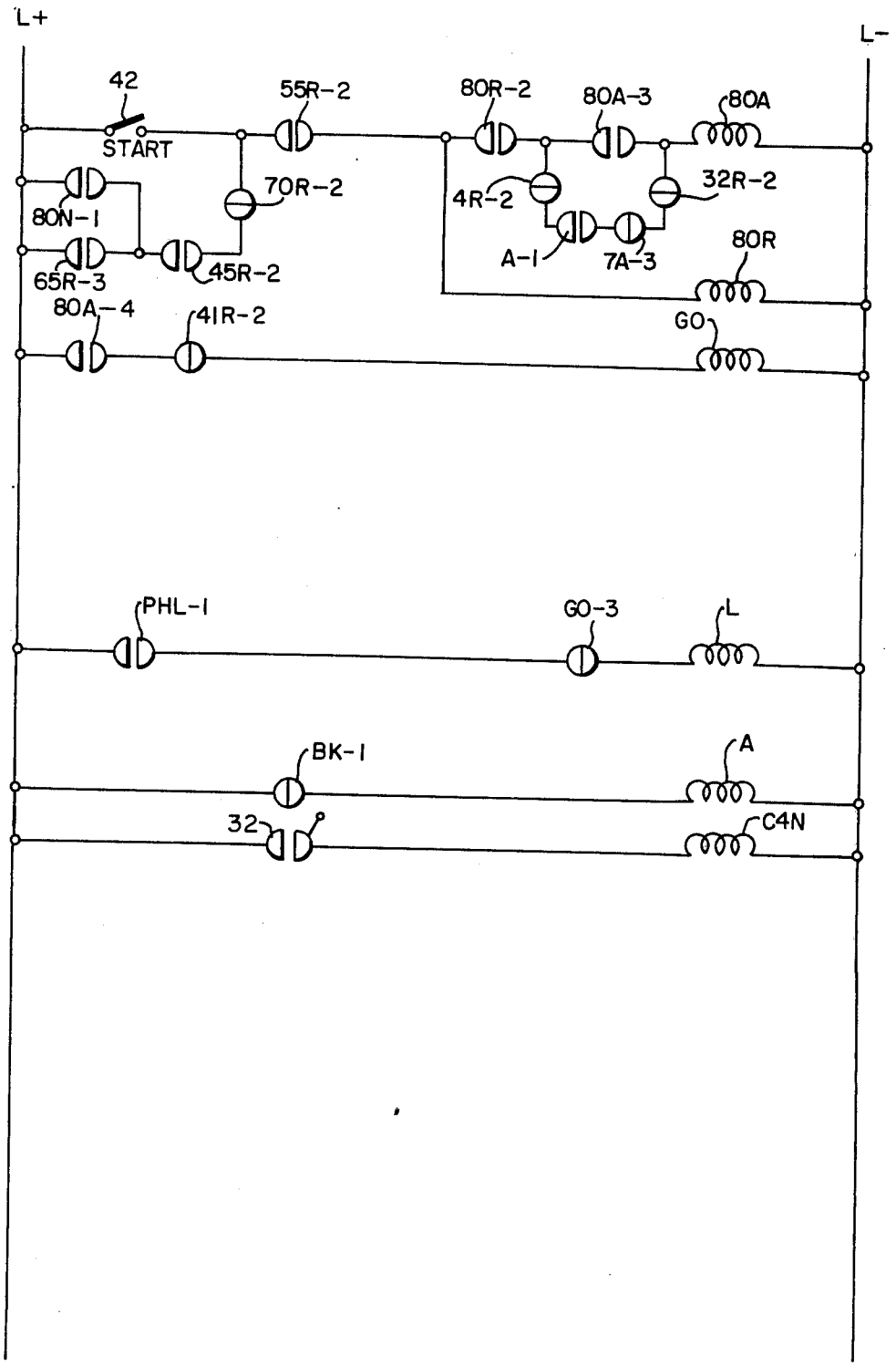

Before describing the control circuits of FIGS. 6 and 7 in detail, it will be helpful to list the components which are illustrated in the control circuitry.

| Symbol | Function |
|---|---|
| 1R | Up running relay |
| 2R | Down running relay |
| 3R | Brake control relay |
| 4R | Brake control relay |
| 7A | Loop circuit contactor |
| 23A | Running relay which picks up when the floor selector advances prior to a run and drops out when the run is completed and the car stops |
| 29R | Safety circuit relay |
| 32R | Running relay which is energized whenever brake control relay 3R is energized |
| 32L | Running relay which picks up when the doors close as the car prepares to make a run and drops out when the car stops at the end of a run |
| 34R | Master slowdown relay which picks up when the car prepares to stop at a floor and stays picked up while the car is stopped until the door starts to close |
| 40R | Car door relay which is picked up when the door is closed and dropped out when it is not closed |
| 41R | Hatch door relay which is picked up when the hatch door is closed and dropped out when it is not closed |
| 45R | Master close door relay which picks up when the doors are commanded to close |
| 55R | Overspeed relay which drops out on overspeed and is otherwise energized |
| 65R | Running relay which picks up when the master start relay 80A is energized |
| 70R | Relay which is picked up during the door non-interference time |
| 80R | Master start relay - picks up when the elevator car is to make a run |
| 80A | Auxiliary to master start relay 80R which picks up when 80R picks up if relays 4R, 7A and 32R are dropped out and relay A is energized |
| 80N | Automatic start relay which is effective when the elevator car is on automatic service to initiate starting of the elevator car |
| 82U | Selector - up direction |
| 82D | Selector - down direction |
| A | Brake monitor - picked up when brake is applied (i.e., set) |
| BK | Brake solenoid coil - lifts or releases brake when energized - spring sets brake when BK is de-energized |
| BPF | Relay which is picked up at a predetermined position of the car door when it is closing, and which drops when the door reaches the closed position |
| C4N | Relay which picks up at a predetermined door position when the door is closing and remains picked up until the door reaches this position when opening |
| DL | Down travel limit switch |

-continued

| Symbol | Function |
|---|---|
| GO | Relay which picks up when the auxiliary master start relay 80A is energized, and which drops out when the doors close |
| L | Leveling zone relay which is energized when the elevator car is within .25 inch of floor level, and it drops out to initiate leveling when the elevator car moves .25 inch away from floor level |
| L2 | Leveling zone relay which drops out when the elevator car is within 10 inches from the floor level |
| L3 | Leveling zone relay which is similar to L2 except for 20 inches |
| PHL | Photoelectric relay which picks up when light strikes the leveling photocell and is otherwise dropped out |
| TR | Transfer relay |
| UL | Up travel limit switch |

Referring now the control circuits shown in FIGS. 6 and 7, they will first be described as they would normally perform in the prior art. Then, the changes taught by the present invention will be described to clearly point out the effect of the changes.

A safety relay 29R must be energized from electrical supply conductors L+ and L−, or the elevator car will not move away from the floor. The safety relay 29R is connected between conductors L+ and L− via a plurality of conventional safety circuits, indicated generally at 40, and via a parallel circuit 41 which includes break contact 70R-1 in one branch, and its own make contact 29R-1 in the other branch. Relay 70R (not shown) is energized when the car door opens, and it is de-energized at the end of the selected non-interference time. If the safety circuits 40 are all closed when relay 70R drops to close its contacts 70R-1, relay 29R picks up and seals in around contact 70R-1 via contact 29R-1. Thus, once the elevator car is initially placed in service, relay 29R remains energized until a contact in the safety circuits 40 opens to drop out relay 29R.

Relays 1R and 2R are up and down direction running relays, respectively, one of which is energized when the elevator car is to make a run, and when the elevator car is leveling, with the specific relay energized depending upon the direction the car is to move. When the elevator car is to make a run, the master start relays 80R annd 80A shown in FIG. 7 pick up and contact 80A-1 in FIG. 6 closes. In addition, one of the up or down direction relays 82U or 82D, respectively, (not shown) is energized. The up or down direction relay 82U or 82D is energized by an attendant's switch in the elevator car when the elevator car is on attendant service, or automatically by direction circuits which compare the car's position and the location of a car or hall call, or by a signal from the leveling device.

When the up direction relay 82U is energized its contact 82U-1 closes and relay 1R is energized when the car and hatch doors close through the circuit which includes:

Safety circuits 40, 29R-1, L2-2, 40R-1, 41R-1, 55R-1, 45R-1, 80A-1, 82U-1, 2R-1, 1R, UL.

When the doors close the leveling relay L2 picks up and thus its contact L2-2 is closed. When the car and hatch doors close relays 40R and 41R, respectively, pick up to close contacts 40R-1 and 41R-1. Contact 80A-1 closes when the master start relay 80A picks up. Contact 45R-1 closes when the master door relay 45R picks up to direct door closure. Contact 55R-1 is closed when relay 55R is energized, indicating relay 55R has not dropped out due to a car overspeed condition. Contact 82U-1 is closed when the up direction relay 82U is energized. Contact 2R-1 is closed since the down direction running relay 2R is not energized. Limit switch UL is closed except when the elevator car is located at the uppermost floor.

If the down direction relay 82D picks up instead of the up direction relay 82U, contact 82D-1 will close and the down running relay 2R will pick up in a manner similar to that just described for the up direction running relay 1R, with the circuit including:

Safety circuits 40, 29R-1, L2-2, 40R-1, 41R-1, 55R-1, 45R-1, 80A-1, 82D-1, 1R-1, 2R, DL.

When the up running relay 1R picks up it opens its contact 1R-1 to isolate the down running relay 2R, and it closes its contacts 1R-2 and 1R-3. If the power supply for the elevator drive motor is ready to provide voltage, the loop circuit relay 7A (not shown) is energized which closes its contact 7A-1 (FIG. 2) to connect the power supply to the elevator drive motor and its contact 7A-2 in FIG. 6 closes to energize brake control relays 3R and 4R to enable at least the partial lifting of the brake 7 shown in FIGS. 1 and 2, which is presently set to restrain rotation of the drive sheave 18. Contacts 4R-1 and 3R-1 thus close to energize the running relay 32R and to energize the brake coil BK through resistor 40. Contact 65R-2 closes to provide a circuit in parallel with contact 80A-2 of the master start relay 80A. Running relay 32L is also energized when the doors close via contact 34R-3 of the master slow-down relay 34R which drops when the doors start to close, contact 40R-2 of the car door relay which picks up when the car door reaches its closed position, and contact 80R-1 of the master start relay 80R. Contact 32L-1, along with contact 32R-1 seal relay 32L in, by-passing the contacts which initially energized relay 32L.

When running relay 65R picks up, it closes its contact 65R-1 thus providing a new circuit for maintaining the energization of the up running relay 1R which includes:

Safety circuits 40, 29R-1, L2-2, 40R-1, 41R-1, 65R-1, 1R-2, 2R-1, 1R, UL.

If the down running relay 2R was energized, instead of the up running relay 1R, a new circuit is formed by contact 65R-1 for maintaining the energization of the down running relay 2R, which includes:

Safety circuits 40, 29R-1, L2-2, 40R-1, 41R-1, 65R-1, 2R-2, 1R-1, 2R, DL.

The control circuits shown in FIG. 7 illustrate the master start relays 80A and 80R. The master start relay 80R may be energized via the attendant's switch 42, if the overspeed relay 55R is energized, through contact 55R-2. The master start relay 80R may be energized through contact 80N-1 of the automatic start relay 80N (not shown) when the elevator car is on automatic operation, the doors are closed, and it is requested to make a run by a call for elevator service or by a signal by supervisory control. This circuit for relay 80R includes:

80N-1, 45R-2, 70R-2, 55R-2, 80R.

Contact 45R-2 closes when the doors are requested to close, and contact 70R-2 closes when the door non-interference time expires. When running relay 65R (FIG. 6) picks up, its contact 65R-3 closes to provide a circuit in parallel around contact 80N-1.

When master start relay 80R picks up it closes its contact 80R-2 to enable the auxiliary master start relay 80A (FIG. 7). The master start relays 80R and 80A pick up before the up or down running relays 1R or 2R, and thus the brake control relay 4R is de-energized and its contact 4R-2 is closed. Contact A-1 of the brake monitor relay A is closed since the brake is set and relay A is energized. Contact 7A-3 is closed since the loop circuit relay or contactor 7A is a de-energized at this point, and contact 32R-2 will be closed since running relay 32R is de-energized. If any of the relays 4R, 7A or 32R are energized, or relay A is de-energized, the car will not run as relay 80A will not pick up.

When relay 80A picks up it closes its contact 80A-3 to by-pass contacts 4R-2, A-1, 7A-3 and 32R-2.

The brake monitor relay A may be responsive to the mechanical position of the brake 7, as illustrated in FIG. 2, such as by a cam on the brake plunger which closes a contact BK-1 when the brake is set, and which allows the contact BK1 to open when the brake is released. As illustrated in FIG. 7, contact BK-1 is connected to control the energization of the brake monitor relay A.

As illustrated in FIG. 3, the photoelectric relay PHL is energized when the elevator car is within ±0.25 inch of floor level, which closes its contact PHL-1. As illustrated in FIG. 7, contact PHL-1 is connected to control the leveling relay L, picking relay L up when the elevator car is within the ±0.25 inch leveling zone, and dropping the leveling relay L out when the car moves outside this zone.

Door position relay C4N is controlled by switch 32 shown in FIG. 5, energizing relay C4N (FIG. 7) when the closing door reaches the location of switch 32, such as about 4.5 inches (114 mm.) from the fully closed position.

When the elevator car approaches a floor at which it is to stop and reaches the outer leveling zone, such as 20 inches from floor level, relay L3 (not shown) drops to close its contact L3-1 in FIG. 6, the master slow-down relay 34R is energized and its contact 34R-2 is closed, and the running relay 23R is energized at this point so its contact 23R-1 is closed, to maintain the directional running relay 1R or 2R energized until the car stops at floor level. Leveling is effective when the car is stopped at a floor with its door open, as leveling relays L2 and L3 are dropped out to close contacts L2-1 and L3-1, respectively, and relay L is picked up to open its contact L-1. When the car moves outside of the ±0.25 inch zone, relay L drops, to close its contact L-1 and enable the leveling circuit. At this point, contact 34R-2 is closed, and it stays closed until the doors start to close. Thus, when leveling relay L drops out to initiate leveling, the operation of a direction relay 82U or 82D by the leveling circuits picks up the associated directional running relay 1R or 2R. The pick up of a directional running relay energizes the brake control relays 3R and 4R and the brake is partially released to enable the drive motor to overcome the restraint of the brake and relevel the car. When the doors start to close, master slow-down relay 34R drops out and opens its contact 34R-2 to disable the leveling of the car.

According to the teachings of the invention, the car position is monitored while the doors are closing, the unbalanced load is monitored while the doors are closing, the brake is partially released when the elevator car receives a signal to start, and the initiation of full brake release occurs before the doors are fully closed, resulting in the unbalanced load being corrected for during door closure. Thus, when the doors reach the closed position, the car is ready to go and may depart immediately without delay due to the L/R time constant of the brake coil. Further, since the drive motor is already supplying the torque necessary to hold the car at floor level, the elevator car will start smoothly from the floor level as the drive motor does not have to search for the necessary armature current to offset the unbalanced load. These functions are implemented by maintaining the floor leveling control 30 (FIGS. 1, 3 and 4) active when the doors are open, and while the doors are closing, and by activating the elevator drive motor and brake when the car receives a start signal. The combined effect of the leveling device, partial brake release and armature current buildup in the drive motor will initiate the search for the torque required to support the unbalanced load. The car position is controlled by the leveling device as the brake releases, and any unbalanced load which would tend to move the car is offset by a motor torque which positions the car precisely at floor level.

When the doors reach a predetermined position while closing, which position is selected to prevent passenger transfer while allowing sufficient time for complete brake release, the complete release of the brake is initiated. When the doors reach the fully closed position, the transfer relay TR transfers the speed pattern from the floor leveling device to the acceleration portion of the speed pattern generator.

In an example of how the above functions may be implemented with the circuitry shown in the drawings, a relay GO is provided in FIG. 7 which is energized from the time the car receives a start signal, i.e., the pick up of the master start relay 80A, until the doors reach the fully closed position, i.e., the pick up of the hatch door relay 41R. Thus, as illustrated in FIG. 7, when relay 80A picks up and closes its contact 80A-4, relay GO is energized, and it remains in the energized state while the doors are closing. When the doors reach the closed position, contact 41R-2 opens and drops relay GO.

A make contact GO-1 of relay GO is connected across contact 34R-1 of the master slow-down relay 34R in FIG. 4, a make contact GO-2 is connected across contact 34R-2 in FIG. 6, and a break contact GO-3 is connected in series with leveling relay L in FIG. 7. Thus, the floor leveling circuits are maintained during door closure.

A relay BPF (FIG. 6) is also provided which is energized through a make contact GO-4 of relay GO and a make contact C4N-1 or relay C4N. When the doors are closing contact GO-4 will be closed, and when they reach the predetermined position where relay C4N picks up, contact C4N-1 closes to energize relay BPF. Relay BPF has a contact BPF-1 connected to short out a predetermined portion of the brake resistor 40 when relay BPF is energized.

In the operation of the elevator system according to the teachings of the invention, when the elevator car receives a start signal and master start relay 80A is energized, relay GO picks up and its contacts GO-1, GO-2 and GO-3 maintain the floor leveling device effective, with contact GO-3 dropping relay L to initiate and maintain stretch of cable leveling during door closure. Relay 7A picks up to energize the armature MA of the drive motor 1 (FIG. 2) and the brake relays 3R and 4R are energized to energize the brake coil BK through resistor 40 to partially release the brake and allow torque buildup in the drive motor 1 to assist the mechanical brake during door closure. Then, as soon as the closing door reaches a position where passenger transfer is no longer possible, such as 4.5 inches (114 mm.) from the closed position, relay C4N is energized and its contact C4N-1 closes to energize relay BPF. Relay BPF-1 closes to short a selected portion of brake resistor 40, which initiates a gradual release of the brake without bounce of the elevator car on its cables. When the doors reach the closed position, relays GO and BPF drop out and relay 32L picks up. Contact 32L-2 of relay 32L closes to short out a still larger portion of the brake resistor 40, to insure that the brake is fully released. Contacts TR4 and TR5 (FIG. 4) of the transfer relay TR open and other contacts of the transfer relay close to connect the pattern motor of the speed pattern generator to the acceleration portion of the speed pattern, and the elevator car leaves the floor smoothly and without delay. The smooth start is due to the fact that the drive motor gradually builds up torque to support the unbalanced load as the doors are closing, and the prompt start is achieved by the fact that the brake is fully released when the doors reach the closed position, as the L/R time constant of the brake is used up during door closure. The operation is safe because full brake release is initiated only after the doors reach a position where passenger transfer is not possible, and transfer from the leveling device to the acceleration pattern occurs only after the car and hatch doors are closed and locked.

We claim as our invention:

1. A traction elevator system in which the time required to start a motor driven elevator car stopped at a floor with its door open and brake set is reduced, and the start away from the floor when the elevator car makes a run is smooth notwithstanding an unbalanced load, comprising:

means closing the door of the elevator car preparatory to a run, means monitoring the position of the elevator car relative to the floor while the door is closing, means releasing the brake before the door reaches the closed position, means correcting for unbalanced load when the brake is released to hold the elevator car at floor level, and means starting the elevator car away from the floor when the door reaches the closed position.

2. The elevator system of claim 1 wherein the means releasing the brake does so in at least two steps, with the first step being a partial release of the brake, and with a subsequent step initiating full release of the brake.

3. The elevator system of claim 1 wherein the means monitoring the position of the elevator car includes leveling means, and the means correcting for unbalanced load includes an elevator drive motor which builds up the armature current necessary to hold the elevator car at floor level in response to said leveling means.

4. The elevator system of claim 1 including means responsive to door position providing a first door signal when the door is closing and it reaches a predetermined position, with the predetermined position being selected such that the time from this position to the closed position is adequate for full release of the brake, and the position prevents passenger transfer, and wherein the means releasing the brake is responsive to the first door signal.

5. The elevator system of claim 1 including means responsive to door position providing a second door signal when the door reaches the closed position, with the means starting the elevator car away from the floor being responsive to the second door signal.

6. The elevator system of claim 1 in which the means releasing the brake before the door reaches the closed position initiates the release with a transition which results in substantially full brake release by the time the door reaches the closed position.

7. An elevator system, comprising:

an elevator car having a door, motive means for moving the car to provide service for selected landings of a structure, a brake for restraining movement of the elevator car when it is operated from a released to a set condition, control means for operating the motive means to start the elevator car away from a landing, to stop the elevator car at a selected landing, and to maintain the elevator car within a predetermined landing zone at a landing at which the elevator car is stopped, means for opening the door of the elevator car as the elevator car stops at a selected landing to permit passenger transfer, means for setting the brake to restrain movement of the elevator car after the elevator car stops at a landing, means for closing the door of the elevator car preparatory to starting the elevator car away from the landing, and means for releasing the brake in at least two steps, with a step after the initial step initiating full release of the brake at a predetermined point when the door is closing, with the predetermined point being selected to permit the brake to be substantially completely released by the time the door is closed while preventing passenger transfer during this time, said control means starting the elevator car away from the landing after the door reaches the closed position.

8. An elevator system, comprising:

a structure having a plurality of landings, an elevator car having a door operable between open and closed positions, motive means for moving said elevator car relative to said structure to serve the landings, brake means operable between a set condition wherein the brake means restrains the elevator car against movement by said motive means and a released condition wherein the motive means is free of such restraint, leveling means operating in response to the position of said elevator car within a predetermined zone adjacent each landing at which the elevator car is stopping, and at which it is stopped, door position responsive means providing a first signal when said door reaches a predetermined position when it is closing, and a second signal when said door reaches the closed position, motive control means providing signals for starting the elevator car away from a landing, and for stopping the elevator car at a selected landing, door control means opening the door of said elevator car as the elevator car stops at a landing, and brake control means operating said brake means to its set condition after the elevator car stops at a landing, said door control means initiating closure of said door when the elevator car is about to leave a landing, said brake control means partially releasing the brake when the elevator car is about to leave the landing, and being responsive to said first signal for initiating substantially full release of said brake means before said door reaches its closed position, with said leveling means operating to maintain the elevator car at the landing as the brake means is released, said motive control means providing said signal for starting the elevator car away from the landing after said door reaches its closed position.

* * * * *